US012766429B2

(12) United States Patent
Wang

(10) Patent No.: US 12,766,429 B2
(45) Date of Patent: Oct. 20, 2026

(54) STABILIZING CONNECTOR AND BUILDING TOY KIT

(71) Applicant: Laltitude LLC, Hacienda Heights, CA (US)

(72) Inventor: Howard Wang, Hacienda Heights, CA (US)

(73) Assignee: Laltitude LLC, Hacienda Heights, CA (US)

( * ) Notice: Subject to any disclaimer, the term of this patent is extended or adjusted under 35 U.S.C. 154(b) by 554 days.

(21) Appl. No.: 17/885,227

(22) Filed: Aug. 10, 2022

(65) Prior Publication Data

US 2024/0050869 A1 Feb. 15, 2024

(51) Int. Cl.
*A63H 33/08* (2006.01)

(52) U.S. Cl.
CPC ..... *A63H 33/08* (2013.01)

(58) Field of Classification Search
CPC ... A63H 33/086; A63H 33/088; A63H 33/108
See application file for complete search history.

(56) References Cited

U.S. PATENT DOCUMENTS 2,861,388 A * 11/1958 Favaretto ..... A63H 33/086 446/124
2,885,822 A * 5/1959 Onanian ..... A63H 33/101 174/138 D
2,983,071 A * 5/1961 Oliver ..... A63H 33/108 403/174
3,005,282 A * 10/1961 Christiansen ..... A63H 33/086 446/128
3,324,619 A * 6/1967 Gearhart ..... A63H 33/086 446/128
3,570,170 A * 3/1971 Kishi ..... A63H 33/086 446/128

(Continued)

FOREIGN PATENT DOCUMENTS

KR 20150127817 A 11/2015

OTHER PUBLICATIONS

International Search Report for corresponding application PCT/US2023/068463 dated Sep. 27, 2023.

(Continued)

*Primary Examiner* — Nicholas J. Weiss
(74) *Attorney, Agent, or Firm* — Bochner PLLC; Joseph Farco

(57) ABSTRACT

A stabilizing connector and construction toy kit are provided. The construction toy kit contains a plurality of tiles, each comprising a first and second plate connected by a sidewall, and at least one aperture defined by the first plate and configured to receive one of a plurality of connection studs extending from an inner surface of a stabilizing connector base. That is, the plurality of connection studs may be configured to, simultaneously, removably secure with at least one aperture of a first tile and at least one aperture of a second tile. In this manner, the stabilizing connector is operative to reduce movement of any tiles secured with the stabilizing connector in all three dimensions with respect to one another. A post extending from an outer surface of the base of the stabilizing connector may be operative to support at least one accessory, such as a tree, building, or sign.

20 Claims, 5 Drawing Sheets

(56) References Cited

U.S. PATENT DOCUMENTS

| | | | | |
|---|---|---|---|---|
| 4,012,155 | A * | 3/1977 | Morris | A47B 87/0207 403/360 |
| 4,270,303 | A * | 6/1981 | Xanthopoulos | A63H 33/086 446/128 |
| 5,049,105 | A * | 9/1991 | Glickman | A63H 33/10 446/107 |
| 5,743,779 | A * | 4/1998 | Nielsen | A63H 23/005 446/160 |
| 6,682,385 | B2 * | 1/2004 | Atzen | A63H 33/088 446/124 |
| D688,753 | S | 8/2013 | Holm | |
| 8,690,631 | B2 * | 4/2014 | Nag | A63H 33/086 446/128 |
| 9,120,028 | B2 * | 9/2015 | Wilson | A63H 19/30 |
| 2007/0178800 | A1 * | 8/2007 | Kim | A63H 33/084 446/124 |
| 2012/0071061 | A1 * | 3/2012 | Smith | A63H 33/086 446/128 |
| 2017/0239588 | A1 | 8/2017 | Roth et al. | |
| 2019/0143236 | A1 | 5/2019 | Cecchin et al. | |
| 2020/0238191 | A1 | 7/2020 | Hyun | |

OTHER PUBLICATIONS

Search History for corresponding application PCT/US2023/068463 dated Aug. 24, 2023.

* cited by examiner

STABILIZING CONNECTOR AND BUILDING TOY KIT

GOVERNMENT CONTRACT

Not applicable.

COPYRIGHT & TRADEMARK NOTICES

A portion of the disclosure of this patent document may contain material which is subject to copyright protection. This patent document may show and/or describe matter which is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

CROSS-REFERENCE TO RELATED APPLICATIONS

Not applicable.

STATEMENT RE. FEDERALLY SPONSORED RESEARCH/DEVELOPMENT

Not applicable.

TECHNICAL FIELD

The disclosed subject matter relates generally to building toys and kits for creative and educational play and, more particularly, to stabilizing connectors configured to not only secure a building toy tile with another such tile in a kit, but also support tile accessories.

BACKGROUND

Typical construction toys include race tracks, bristle blocks, interlocking construction bricks, and tiles, among others. These toys all share a common issue: connectable elements of each toy piece must be directly connected to each other via a complimentary connectable elements on another toy piece. This limits the connectability and creative use of such toys since complimentary connectable elements must be aligned in set configurations to connect the toy pieces. Additionally, the connection strength is controlled by the existing connection between the two components, requiring either significant overlapping surface area or complex connection elements to stabilize the connected components. To that end, U.S. Pat. No. 4,146,991 to Sano proposes an improvement to certain race track toys by providing flexible trackways that terminate in locking male and female flanges. This eliminates a need to correctly orient each component of the track, however, it may require increased dexterity and strength over traditional models, as an additional connector element must be inserted accurately between each of the components to operate.

Another proposal, U.S. Pat. No. 10,022,640 to Schwartz provides a method for track connection using magnets, however, this type of proposal creates its own slew of problems. Magnets in general reduce some dexterity and strength required to connect elements in interlocking construction toy kits. However, the connection of each element, such as connectable portion of certain race tracks, is typically weaker, allowing for a user to misalign pieces, and thus for vehicles or other accessories used with such tracks to de-rail. Further, even if the exemplary tracks are properly aligned at the beginning, the force of a vehicle accessory on the track and the relatively weak magnetic connection may lead to misalignment during use causing similar de-railment.

Yet another proposal for a connection piece is illustrated in U.S. Design Patent No. D688,328 to Holm. This proposal illustrates an angled connection piece used with popular and commonly available construction bricks, such as Legos®. While the design proposed in Holm may be used to connect two bricks together, it does not act as a stabilizer, instead, allowing free movement of the connected bricks in all but one direction. Furthermore, the design proposed in Holm does not teach, nor suggest, using the connection piece as, or in combination with, an accessory.

Thus, although there are many construction toys on the market, none provide a toy kit or connector that combines the characteristics of the present invention. As such, there is a need for an improved stabilizing connector that reduces movement of the connected toy components and supports additional accessories.

SUMMARY

This disclosure is directed to a construction toy kit which may comprise at least one tile and at least one stabilizing connector configured to further secure and stabilize tiles connected to one another. More particularly, each of the stabilizing connectors may comprise a plurality of connection studs extending from the base and configured to removably secure with apertures in a plurality of tiles.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In accordance with one embodiment, the base of the stabilizing connector may comprise a first and a second arm having an inner surface and an outer surface. In some embodiments, the inner surface of the base may comprise the plurality of connection studs. More particularly, the plurality of connection studs may extend from the inner surface of the base. However, in another embodiment, the plurality of connection studs may extend from the outer surface of the base. In yet another embodiment, the plurality of connection studs may extend from both the inner and outer surfaces of the base.

Each of the at least one tile may comprise a first face and a second face opposing one another, each having an inner surface and an outer surface. The first face may be joined to the second face by a sidewall. In some embodiments, the first face may define at least one aperture extending from the outer surface of the first face towards the inner surface of the second face. In one embodiment, the at least one aperture may extend from the outer surface of the first face through the outer surface of the second face. Each of the at least one apertures may be configured to receive one of the plurality of connection studs.

It is contemplated that when in use, the inner surface of the stabilizing connector base may contact the outer surface of the first plate of the tile.

In some embodiments, the connection studs may be cylindrical-shaped connection studs. That is, a cross section of the connection stud may be a circle. In another embodiment, the connection studs may have a polygonal shape. The polygonal shape may be any known polygon in the art, including, without limitation, a trigon, tetragon, pentagon, hexagon, or octagon. It is contemplated that angles defining the polygonal shape of the connection studs may advantageously, securely contact or press against an outer surface defining the aperture and prevent movement of the connection stud within the aperture when engaged, as in press fitting, friction fitting, or interference fitting. However, a person of ordinary skill will appreciate the aforementioned shapes are for example only and any suitable shape may be utilized.

In a further embodiment, the connection studs may be split-body connection studs. The split body connection stud may be defined by at least one slit operative to divide at least some of the connection stud into two pieces. However, in another embodiment, each connection stud may comprise multiple slits, operative to divide the connection stud into any number of pieces as needed or desired. For example, the exemplary cylindrical-shaped connection stud may be defined by a slit operative to divide the cylindrical-shaped connection stud into two pieces. In another example, the polygonal-shaped connection stud may be defined by a number of slits operative to separate each side of the polygon from one another. It is contemplated that the split-body connection stud may be operative to removably secure with apertures of a plurality of sizes. The pieces of the connection stud, defined by the at least one slit, may flex and change the diameter of at least some portion of the connection stud. For example, the pieces of the connection stud may flex into or toward the slit upon contact with any surfaces defining a tile aperture. It is contemplated that this will result in a secure friction-fit between an outer surface of the connection stud and surface of such aperture. In some embodiments, the split-body connection stud may be operative to secure with apertures smaller than the overall diameter of the connection stud, owing to the flexion that may operatively decrease the diameter of the connection stud.

In one embodiment, the stabilizing connector may further comprise a post extending from the base. In some embodiments, the post may extend from the outer surface of the base, however, in another embodiment the post may extend from the inner surface of the base. The post may be configured to support at least one accessory. In some embodiments, the at least one accessory may be permanently connected to or otherwise bodily integrated with the post. In other words, the at least one accessory and the post may form a continuous structure. However, in another embodiment, the at least one accessory may be removably securable to the post. The at least one accessory may comprise at least one attachment means configured to securely and removably engage with the post. The at least one attachment means may be any means capable of engaging with the post, including, without limitation, snap-fit connectors, interference fit connectors, magnets, or any other type of connection that may be contemplated in the art. It is contemplated that the at least one accessory may be any accessory as may be desired in a construction toy kit, including, for example, and without limitation, street, traffic, and other signs; trees and other plants; banners; flags; animals; or any other accessory that may be contemplated and/or desired.

In one embodiment, the second arm of the base extends downward from an edge of the first arm to form an L-shaped stabilizing connector. More specifically the L-shaped stabilizing connector may be formed by the second arm extending downwards at 90° from the edge of the first arm. It is contemplated that in some such embodiments, each of the connection studs may extend from the same arm of the L-shaped stabilizing connector. For example, in one embodiment the plurality of connection studs may extend downwards from the inner surface of the first arm. Thus, the plurality of connection studs may be parallel to the second arm of the L-shaped stabilizing connector. However, in another embodiment, the plurality of connection studs may extend from the outer surface of the first arm of the L-shaped stabilizing connector, thus the second arm and the plurality of connection studs may extend from opposing faces of the first arm of the L-shaped stabilizing connector. A person of ordinary skill will appreciate that the plurality of connection studs may extend from the second arm in any of the aforementioned configurations. In another embodiment, the connection studs may extend from both the first and second arms of the L-shaped stabilizing connector. It is contemplated that in some such embodiments, the connection studs may extend from the outer surface of the first and second arms. In another embodiment, the connection studs may extend from the outer surface of the second arm and the inner surface of the first arm.

In some embodiments, the plurality of connection studs extending from the L-shaped stabilizing connector may be two connection studs, however, any number of connection studs is contemplated. It is contemplated, that the L-shaped stabilizing connector may be operative to connect two tiles. More specifically, the two connection studs may be distributed on the base to engage with apertures located on two adjacent, or even abutting, tiles, further securing the two tiles together. It is contemplated that the second arm of the L-shaped stabilizing connector may extend over the sidewalls of the two tiles and the first arm may extend over the outer surface of the first plate of the two tiles. The first and second arms of the L-shaped stabilizing connector may be operative to reduce the movement of the tiles when engaged. In some embodiments, the tiles may comprise magnetic elements that enable them to be connected to one another, thus it will be seen that securing a stabilizing connector to tiles in this manner will further strengthen and stabilize any existing connection between the tiles.

In some embodiments of the L-shaped stabilizing connector, the post may extend from a midpoint of the outer surface of the first arm. In one embodiment, the post may extend from a point on the outer surface defined by a medial point along the first arm defined by the plurality of connection studs on the inner surface.

However, in another embodiment of the stabilizing connector configured to secure two tiles together, the first and second arm may be arranged along a plane. Thus, in some embodiments, both the inner and outer surfaces of the base may be essentially flat. However, in another embodiment, the first arm and second arm may comprise different heights, such that the inner or outer surface of the base may have unequal heights. It is contemplated that this may be operative to connect tiles comprising different height sidewalls to each other. The plurality of connection studs may, for example, comprise two connection studs. Each of the first and second arm may comprise one of the two connection studs.

In another embodiment, the stabilizing connector may be a miter stabilizing connector wherein an end of the first arm is connected to an end of the second arm to form a 90° angle. Thus, the first arm and the second arm may be connected such that the base of the miter stabilizing connector may be arranged along a plane. In such an embodiment, the connection studs may extend from the first and second arms of the miter stabilizing connector. In some embodiments, the plurality of connection studs may extend from the inner surface of the base. However, in another embodiment, the plurality of connection studs may extend from the outer surface of the base. In yet another embodiment, the plurality of connection studs may extend from the inner and outer surfaces of the base.

In such an embodiment, the plurality of connection studs extending off the miter stabilizing connector may be three connection studs. The three connection studs may be distributed along the first and second arm and be operative to engage with apertures disposed on three tiles. In some embodiments, the connection studs may be distributed such that one of the connection studs is located adjacent to an end of the first arm, one of the connection studs is located adjacent to an end of the second arm, and the third connection stud is located where the first and second arm connect. Thus, the three connection studs may be arranged to form a 90° angle themselves. Each connection stud of the miter stabilizing connector may secure an aperture in one each of three tiles, preventing movement of the tiles when connected.

In yet a further embodiment, the stabilizing connector may be operative to secure four of the at least one tiles to each other. In one embodiment, the first and second arms may be parallel to one another to form the base. More specifically, an inner edge of the first arm may be connected to an inner edge of the second arm. It is contemplated that the first arm and the second arm may be connected such that the base is a continuous structure.

In such an embodiment, each of the first and second arms may comprise at least two of the plurality of connection studs. Thus, the base may comprise at least four coupling studs operative to secure four of the at least one tile to each other. For example, each of the four tiles may comprise at least one aperture configured to receive one of the at least four connection studs.

Several advantages of this stabilizing connector and construction toy are that they:

a.) prevent, by the stabilizing connector, motion in at least three directions when in use;

b.) securely align the plurality of tiles; and c.) increase creativity of the users by allowing various customized connections to be made between toys in a kit.

Thus, it is an object of the stabilizing connector to reduce the movement of the connectable members in at least three directions when in use.

Further, it is an object to stabilize the connection of the tiles in a toy kit while maintaining an aesthetically pleasing kit.

In yet a further embodiment, it is an object of the invention to encourage creative play.

One or more of the above-disclosed embodiments, in addition to certain alternatives, are provided in further detail below with reference to the attached figures. The disclosed subject matter is not, however, limited to any particular embodiment disclosed

Figure 1:
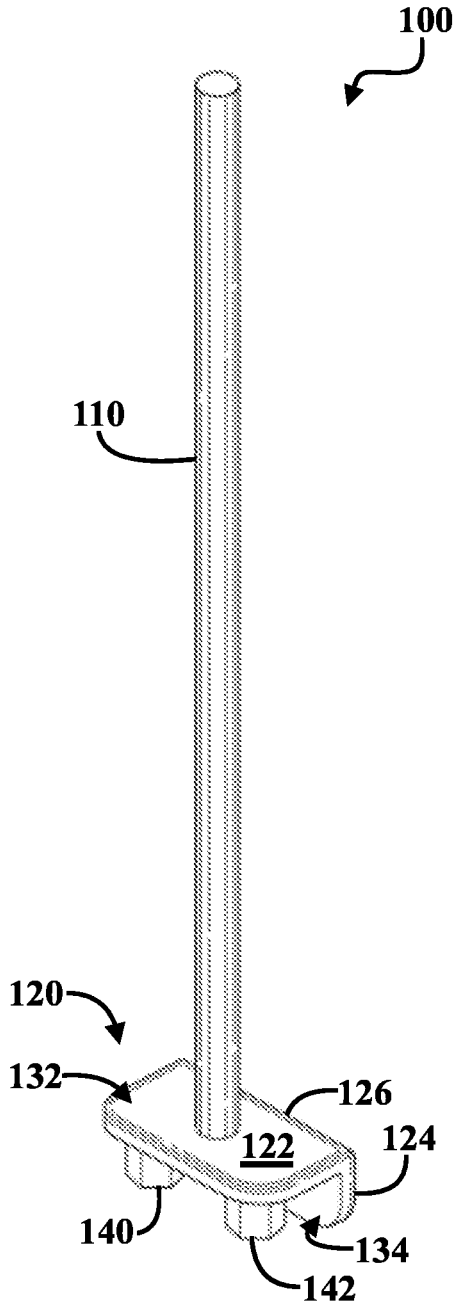
FIG. 1 shows a perspective view of one embodiment of a stabilizing connector.

The disclosed embodiments may be better understood by referring to the figures in the attached drawings, as provided below. The attached figures are provided as non-limiting examples for providing an enabling description of the device and kit claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus The terms "couple," "coupled," "couples," "coupling," and the like should be broadly understood and refer to connecting two or more elements or signals, electrically, mechanically or otherwise. Two or more electrical elements may be electrically coupled, but not mechanically or otherwise coupled; two or more mechanical elements may be mechanically coupled, but not electrically or otherwise coupled; two or more electrical elements may be mechanically coupled, but not electrically or otherwise coupled. Coupling (whether mechanical, electrical, or otherwise) may be for any length of time, e.g., permanent or semi-permanent or only for an instant.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications, and equivalents included within the spirit and scope of the disclosure as defined by the appended claims.

With reference to FIG. 1, one embodiment of an L-shaped stabilizing connector 100 is illustrated. In this embodiment, the L-shaped stabilizing connector 100 comprises a post 110, a base 120, and a plurality of connection studs 140 and 142. The base 120 may comprise a first arm 122 and a second arm 124, an inner surface 134, and an outer surface 132. As shown, the inner surface 134 may be the surface opposing the connection studs 140 and 142. However, a person of ordinary skill will appreciate that the inner and outer surfaces are arbitrary identifiers and should not limit the invention.

As shown in FIG. 1, the first arm 122 and the second arm 124 may be connected along an edge 126 of the first arm 122. The second arm 124 may extend from the edge 126 of the first plate 122 downwards. The second arm 124 may extend from the edge 126 at a 90° angle to the first arm 122. However, in other embodiments, not illustrated, the second arm may extend from the first arm at any angle, including, for example, 15°, 30°, 45°, 60°, 75°, 105°, 120°, or any other angle. Returning to FIG. 1, the second arm 124 may extend downwards from the edge 126 of the first plate 122.

Figure 2:
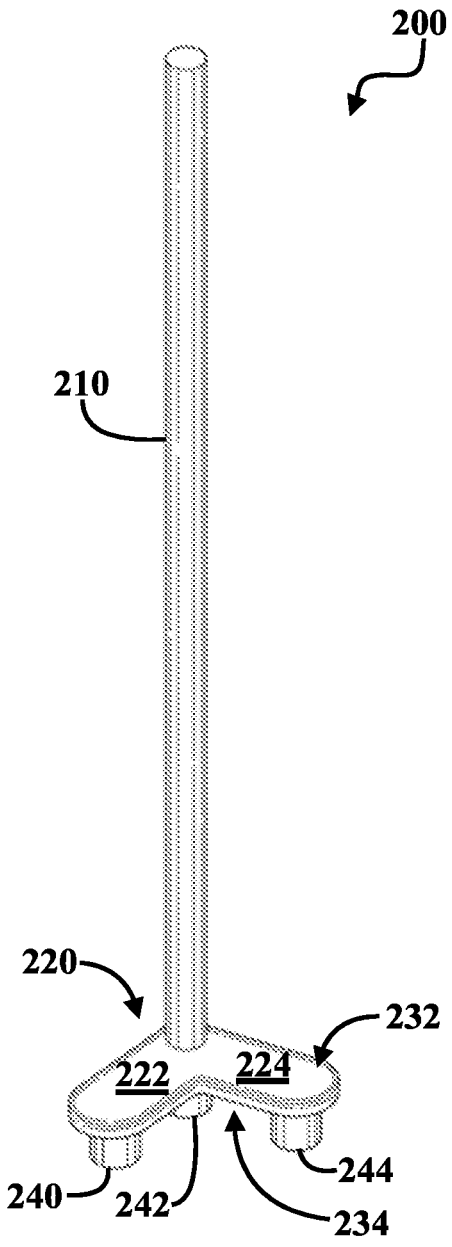
FIG. 2 shows a perspective view of another embodiment of a stabilizing connector.

With reference to FIG. 2, another embodiment of a stabilizing connector is shown. The stabilizing connector illustrated is a miter stabilizing connector 200. The miter stabilizing connector 200 comprises a post 210, a base 220, and a plurality of connection studs 240, 242, and 244. In the embodiment shown in FIG. 2, the base 220 may comprise a first arm 222 and a second arm 224 connected to each other to form a continuous structure. However, it is contemplated that the first arm 222 and the second arm 224 may be separate structures permanently secured to another. The base 220 may have an inner surface 234 and an outer surface 232. It is contemplated that, as shown, the first arm 222 and the second arm 224 may be attached so that the base 220 is flat. In other words, the inner surface 234 of the base 220 may be parallel to the outer surface 232 of the base 220. In some embodiments, the base 220 may be configured along a plane. However, in other embodiments, the first arm 222 may have some vertical height relative to the second arm 224.

In an embodiment, the first arm 222 may be connected to the second arm 224 at a 90° angle. Thus, the base 220 may comprise a 90° bend. It is contemplated that in other embodiments, not illustrated, the first arm and the second arm may be connected at a 15°, 30°, 45°, 60°, 75°, 105°, 120°, 135°, 150°, 165°, or any other angle.

Figure 3:
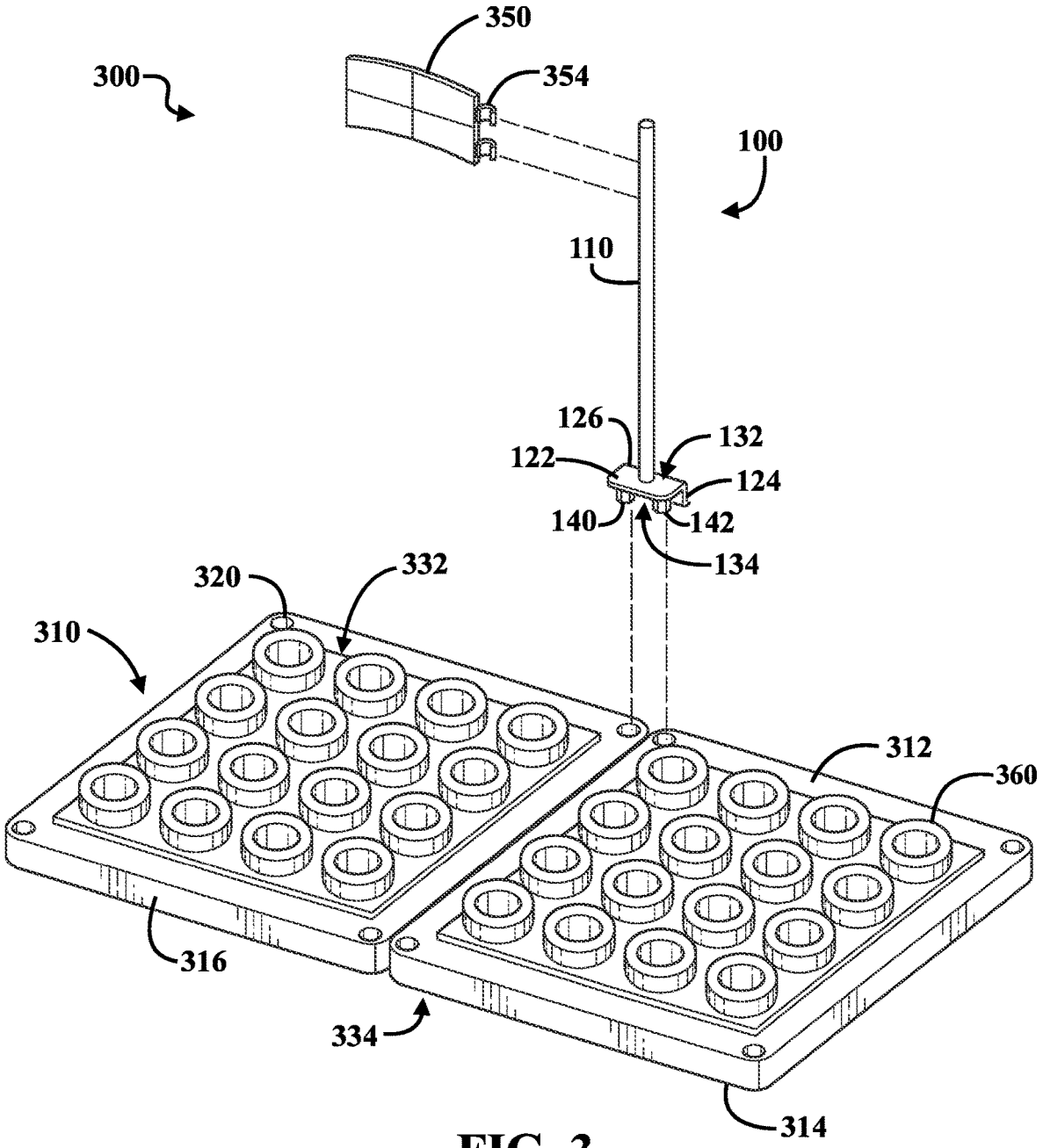
FIG. 3 shows an exploded view of one embodiment of a kit comprising stabilizing connector illustrated in FIG. 1.
Figure 4:
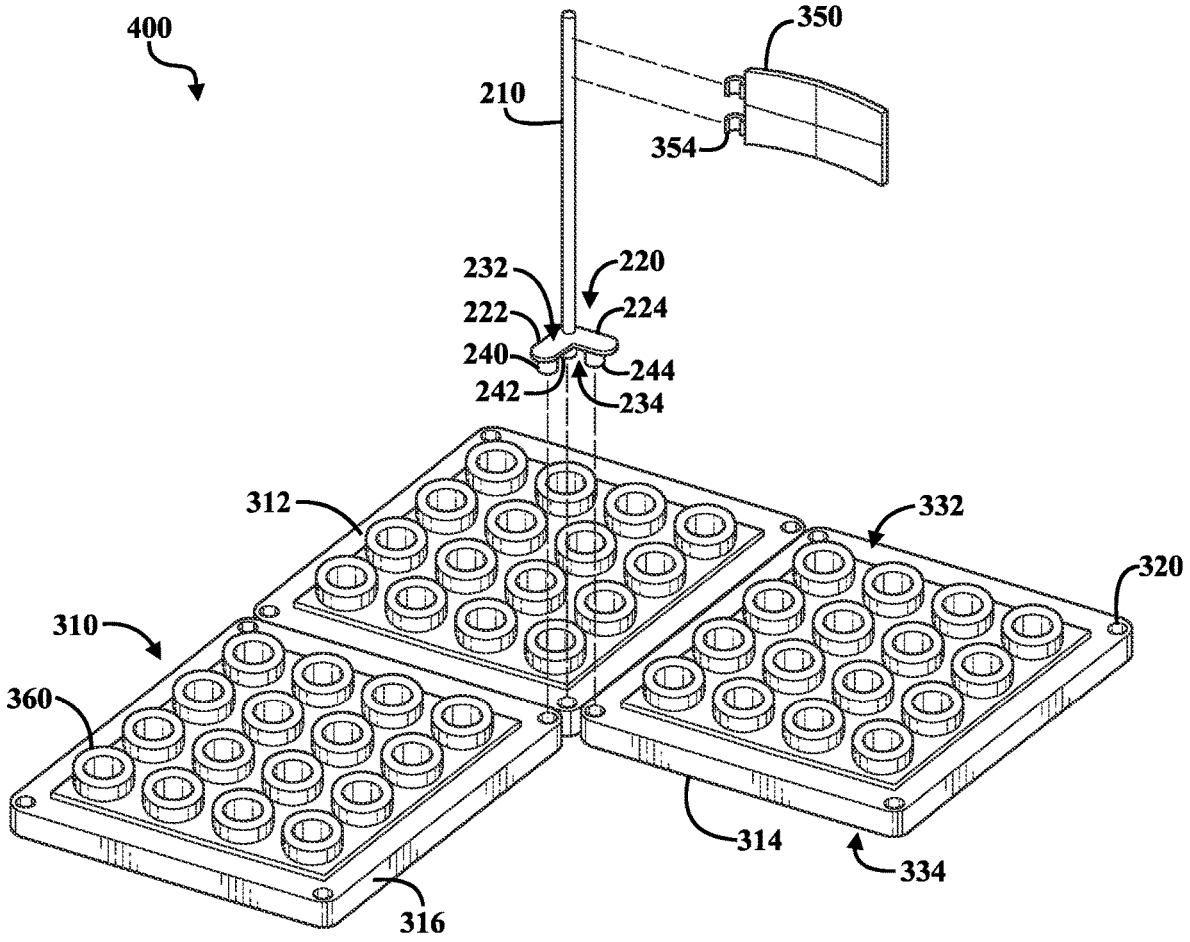
FIG. 4 shows an exploded view of one embodiment of a kit comprising the stabilizing connector illustrated in FIG. 2.

One embodiment of a kit 300 comprising at least one tile 310, specifically two tiles in this case, and the L-shaped stabilizing connector 100 is shown in FIG. 3. FIG. 4 illustrates another embodiment of a kit 400 comprising at least one tile 310, in this case three tiles, and the miter stabilizing connector 200. The at least one tile 310, is common to FIGS. 3 and 4, though, and may comprise a sidewall 316 spacing apart and connecting an opposing first plate 312 and second plate 314. Each of the first plate 312 and the second plate 314 may comprise an inner surface (obscured) and an outer surface 332 and 334, respectively. The first plate 312 may define at least one aperture 320. The at least one aperture 320 may extend from the outer surface 332 of the first plate 312 to the inner surface of the second plate 314. In another embodiment, the at least one aperture 320 may extend from the outer surface 332 of the first plate 312 through the outer surface 334 of the second plate 314.

The at least one tile 310 may comprise at least one coupling stud 360 on the outer surface 332 of the first plate 312. The at least one coupling stud 360 may extend outward from the outer surface 332 of the first plate 312. The at least one coupling stud 360 may be configured to removably secure with a complimentary connector disposed on or defined by an accessory, another tile comprising at least one coupling stud, or any other complimentary connector as contemplated in the art. Such coupling studs 360 may be arranged and configured in any manner necessary or desired to connect or receive additional tiles, toys, and elements configured to engage with such studs.

In some embodiments, the tile 310 may further comprise magnets (obscured from view) embedded or otherwise secured along inner surfaces 334 of the first and second plates 312, 314, such as along the side wall 316. Thus, it may be seen that the tiles can be connected to one another in various ways via magnets. These studs 313, magnets, and any other means of connecting the tiles, will not affect or otherwise limit the invention but are pictured for the purpose of illustrating exemplary embodiments of the types of tiles that may be utilized with the stabilizing connector and in the building toy kit.

Figure 5:
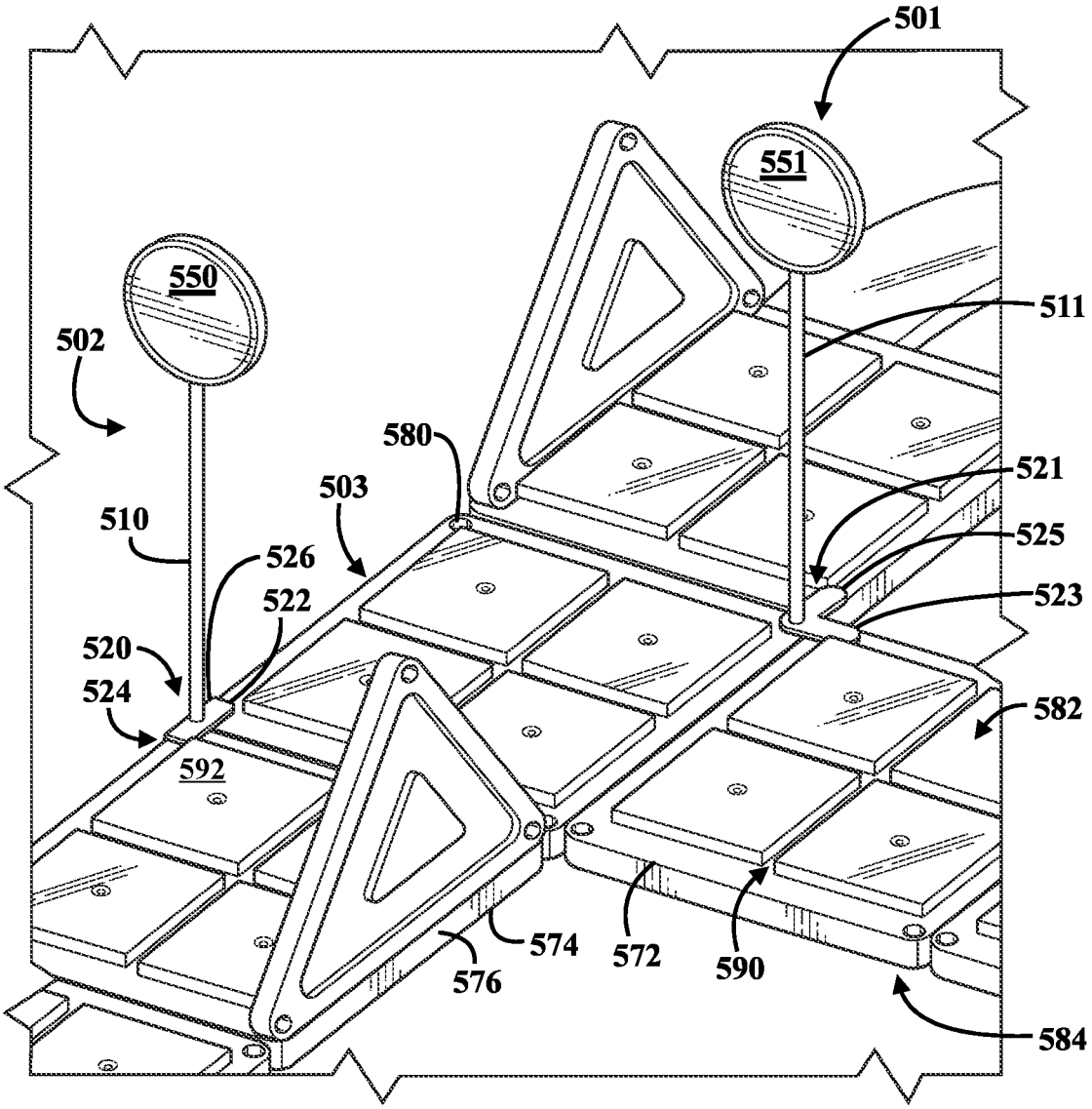
FIG. 5 shows an exemplary embodiment of a kit comprising at least a plurality of stabilizing connectors.

Another embodiment of a kit 500 is shown in FIG. 5 comprising a plurality of connected tiles 503, an L-shaped stabilizing connector 502, and a miter stabilizing connector 501. The at tiles 503 shown in FIG. 5 may comprise at least one sidewall 576 connecting an opposing first plate 572 and a second plate 574. It is notable that the tiles may take a variety of shapes. Here, square and triangles may be seen, however, it is contemplated that the tiles may take any form desired. For example, the tiles 503 may be triangular, circular, rectangular, or take the shape of any other polygon. In some embodiments, the at least one tile may be a non-traditional shape in which each face is defined by a combination of curved and angled edges. The tile may comprise any combination of multiple shapes. In still more embodiments, the tile may be elongated and even arched or curved. In some instances, the plates of each tile may comprise a fork or other feature defining a road or track shape, as needed or desired. Thus, the illustrated tiles are provided by way of example only and not limitation, and it will be recognized that any tile shape is possible to practice the invention, and combinations of tile shapes may be provided in a kit.

With further reference to FIG. 5, each first plate 572 may comprise an inner surface (obscured from view) and an outer surface 582 and 584, the outer surface 582 of the first plate 572 may define at least one aperture 580. The at least one aperture 580 may extend from the outer surface 582 towards the inner surface of the second plate 574. In one embodiment, the at least one aperture 580 may extend from the outer surface 582 of the first plate 572 through the outer surface 584 of the second plate 574.

The exemplary first plate 572 in FIG. 5 may comprise at least one slot 590 (as an alternative to the aforementioned coupling studs) on the outer surface 584. The at least one slot 590 may be define a track operative to guide a moveable toy (not shown) across the interconnected at least one tile 503. The moveable toy may, for example and without limitation, be a toy car, train, plane, or any other form capable of moving along a track. It is contemplated that the moveable toy may comprise a protruding guide configured to the moveable toy around the track.

Continuing with FIG. 5, the at least one slot 590 may define at least one vertices 592. As illustrated, the tile 503 may comprise two slots intersecting at a right angle, defining four vertices. It is contemplated that the four vertices may have a height greater than the slot, however, in another embodiment the vertices may have a height less than the slot. As shown in FIG. 5, the at least one slot 590 may on the first plate 572 and the at least one vertices 592 may extend off the outer surface 582 to define the at least one slot 590.

Returning to FIG. 3, the at least one aperture 320 may, for example be four apertures. In another embodiment however, the at least one aperture 320 may be one, two, three, or even more apertures. It is contemplated that the at least one aperture 320 may be determined by the shape of the tile 320. For example, the tile 310 shown in FIG. 3 is square and may one aperture at each corner of the tile 310. In another embodiment (not shown), the at least one aperture may be multiple apertures located at the corner of the tile or even along each edge of the tile.

It is contemplated that the at least one aperture 320 may be located at a position near the sidewall 316 and operative to engage the at least one connection stud 140 and 142. Thus the at least one aperture 320 may be internal to the sidewall 316 to allow for coupling of the connection stud without compromising the structural integrity of the tile 310.

Returning to the embodiment of the L-shaped stabilizing connector 100 illustrated in FIGS. 1 and 3, the post 110 may extend from the base 120. In the embodiment shown, the post 110 may extend from the first arm 122, however, it is contemplated that the post 110 may extend from any portion of the base 120, including, without limitation, the second arm 124. The post 110 may extend from the outer surface 134 of the first arm 110.

It is contemplated that the post 110 may extend from the base 120 at a 90° angle. In another embodiment, the post 110 may extend off the base 120 at any angle. In the embodiment shown in FIG. 2, the post 210 may extend from the outer surface 232 of the base 120. As shown, the post 210 may extend off the base 220 at a 90° angle, however, it is contemplated that in other embodiments (not shown), the post 210 may extend off the base 220 at any angle. Returning to FIG. 2, the post 210 may extend from the connection of the first arm 222 and the second arm 224. However, in other embodiments, the post may extend from the first or second arm of the base. In such embodiments, the post may be located at any point along the outer surface of the base, including at a midpoint of the first or second arm, In another embodiment, not shown, the base may comprise a plurality of posts. The plurality of posts may extend from any point along the base and may extend at any angle. For example, in some such embodiments, the plurality of posts may extend from points of the outer surface of the base opposing the plurality of coupling studs.

The post 110 and 210 may have any height as needed or desired to receive at least one accessory 350, illustrated in FIGS. 3 and 4. In the embodiments of the at least one accessory 350 illustrated, the at least one accessory 350 may comprise an attachment means 354. The attachment means 354 may be operative to removably secure the at least one accessory 350 with the post 110. As shown in FIG. 3, the attachment means 354 may be a snap-fit connector. However, a person of skill will recognize that any form of attachment means may be utilized, including, for example, and without limitation, means for achieving interference fit, magnets, or any other attachment means known in the art.

In the embodiment illustrated in FIGS. 3 and 4, the at least one accessory 350 may be a sign. The sign may comprise a word, illustration, or combination thereof.

In another embodiment, not illustrated, the accessory may be configured to connect a plurality of posts. Thus, the accessory may comprise at least one attachment means operative to secure with the plurality of posts. For example, the accessory may comprise at least one attachment means, each operative to secure with one post when in use. It is contemplated that the accessory may have a length equal to an edge of a tile.

In some embodiments, the accessory may be sized to extend from a first post to a second post. In another embodiment, the accessory may be sized such that the space between the first and second post is equal to the space between the at least one attachment means. In such an embodiment, the accessory may comprise two attachment means, each located on opposing edges of the accessory.

In some embodiments, the at least one attachment means may be integrated into a body of the at least one accessory. However, in the embodiment shown in FIGS. 3 and 4, the at least one attachment means 354 may be located on at least one edge of the accessory 350.

Further embodiments of stabilizing connectors 501 and 502 are shown in FIG. 5. This embodiment of an L-shaped stabilizing connector 502 is similar to the embodiment of the L-shaped stabilizing connector 100 shown in FIGS. 1 and 3. Returning to the embodiment illustrated in FIG. 5, the L-shaped stabilizing connector 502 comprises a base 520, a plurality of coupling studs (obscured), a post 510, and an accessory 550 permanently secured with the post 510. The base 510 may comprise a first arm 522 and a second arm 524 extending from an edge 526 of the first arm 522. A person of ordinary skill will appreciate that all configurations of the previously discussed L-shaped stabilizing connector 100 may be reflected in the current embodiment of the L-shaped stabilizing connector 502.

As with the embodiment of the miter stabilizing connector 200 shown in FIGS. 2 and 4, the FIG. 5 miter stabilizing connector 501 may comprise a base 521, a plurality of coupling studs (obscured), a post 511, and an accessory 551 permanently secured with the post 511. The base 521 may comprise a first arm 523 and a second arm 525 connected to form a continuous structure. The first arm 523 may be connected to the second arm 525 to form a 90° bend in the base 521. A person of ordinary skill will appreciate that all configurations of the previously discussed miter stabilizing connector 200 may be reflected in the current embodiment of the miter stabilizing connector 501.

For the purposes of brevity and in the interest of clarity, the accessories 550 and 551 of FIG. 5 will be discussed with reference to the L-shaped stabilizing connector 502, however, any embodiment of the stabilizing connectors may be utilized. The accessory 550 may, in some embodiments, be permanently secured to or bodily integrated with the post 510, as shown. For example, the accessory 550 may be a sign, a flag, a light, or any other accessory as needed or desired, attached to the post 511. However, in another embodiment (not shown), the accessory may surround the post. For example, and without limitation, the accessory may be a tree, and the post may form a structural component, such as a trunk. A person of ordinary skill will recognize that the aforementioned embodiments are provided as clarifying examples only, and that any accessory may be utilized.

The exemplary L-shaped stabilizing connectors 100 and 502 illustrated in FIGS. 1, 3, and 5 may comprise the plurality of connection studs 140 and 142 extending from the first arm 122 and 522.

The specific embodiment shown in FIG. 3 is arranged to secure two adjacent tiles 310 to another. For the sake of clarity, the connections studs 140 and 142 are discussed with reference to the embodiment illustrated in FIGS. 1 and 3. The connection studs 140 and 142 may extend from the inner surface 134 of the first arm 122 of the base 120. More particularly, the connections studs 140 and 142 may extend downwards and be operative to engage with one of at least one tile 310 shown in FIG. 3.

The connection studs 140 and 142 may be configured to removably secure with the at least one aperture 320 on the plurality of tiles 300. Thus, the connections studs 140 and 142 may be positioned on the base 320 operative to secure two of the at least one tiles 310 to another. Thus, the distance between the two connection studs 140 and 142 may be equal to a distance between the at least one aperture 320 on adjacent tiles 310. The distance between the two connection studs 140 and 142 and the second arm 124 may be equal to the distance between the sidewall 316 and the at least one aperture 320. In the exemplary embodiment illustrated in FIG. 3, the connection studs 140 and 142 may be located on one side of the base 120 defined by a midline parallel to the second arm 124. However, in another embodiment, the connection studs may be located along the midline. It is contemplated that the positioning of the connection studs 140 and 142 may be dependent on the tiles 310 in the kit 300. It is contemplated that the L-shaped stabilizing connectors 100 in the kit 300 may comprise the connection studs 140 and 142 at varying positions along the first arm 122.

In the embodiment shown in FIGS. 1 and 3, the plurality of connections studs 140 and 142 may be polygonal connection studs. The illustrated polygonal connection studs 140 and 142 are hexagonal connection studs. That is, the cross-section of the exemplary connection stud defines a hexagonal shape. However, the connection studs may be shaped as any polygon without departing from the invention. For example, the polygonal connection studs may be triagons, tetragons, pentagons, heptagons, octagons, or any other polygon. It is contemplated that the polygonal connection studs may be operative to secure with a plurality of sizes of the at least one aperture 320 via interference or friction fitting. The polygonal shape allows a secure fit, while reducing the tolerancing needed to secure cylindrical connection studs. The polygonal shape may be further operative to reduce the rotation of the connection studs when in use. In another embodiment, illustrated in FIGS. 2 and 4, the connection studs 240, 242, and 244 may be cylindrical connection studs.

Figure 6:
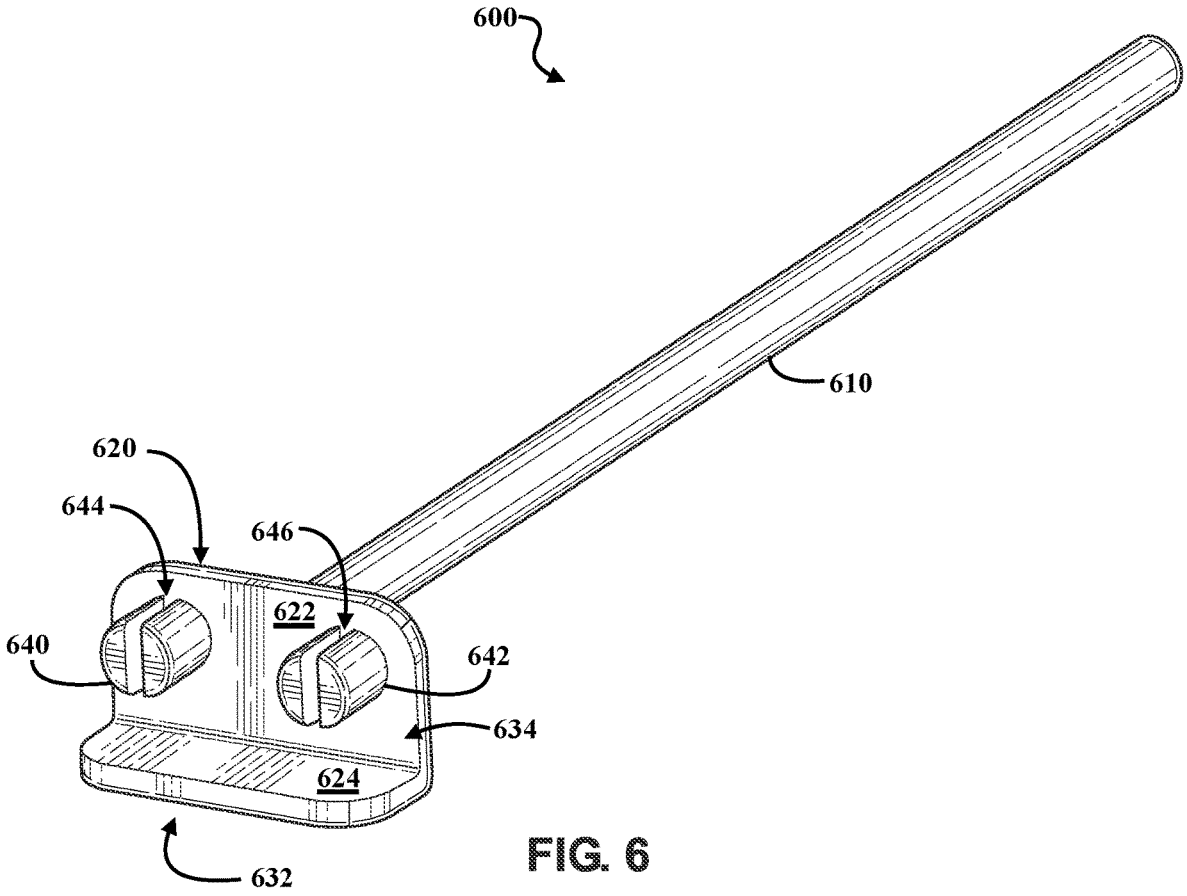
FIG. 6 shows a bottom perspective view of another exemplary embodiment of a stabilizing connector.

FIG. 6 illustrates yet a further exemplary embodiment of a stabilizing connector 600. This illustration shows an exemplary L-shaped stabilizing connector 600 comprises a post 610, a base 620 comprising a first arm 622 and a second arm 624, and an inner surface 632 and an outer surface 634 and a plurality of split-body connection studs. A person of ordinary skill will recognize that any of features comprising exemplary embodiments of the L-shaped stabilizing connector 100 or 502, discussed with reference to FIGS. 1, 3, and 5, above are available to practice the L-shaped stabilizing connector 600 shown in FIG. 6. In addition, it is contemplated that the split-body connection studs may be utilized with any of the aforementioned embodiments of the stabilizing connectors, including, without limitation the miter stabilizing connector 200 and 501 illustrated in FIGS. 2, 4, and 5. That is, the particular configuration of the base of the stabilizing connector shall not limit the form and/or structure of the connection studs.

For the sake of brevity and clarity, an exemplary L-shaped stabilizing connector 600 may comprise split-body connection studs 640 and 642. The split-body connection studs 640 and 642 may be any connection stud, including cylindrical connection studs, comprising at least one slit 644 and 646. For brevity, continued reference is made to the connection stud 640 and the at least one slit 644 and should be understood to encompass the connection stud 642 and the at least one slit 644. The at least one slit 644 may be operative to at least partially divide the connection stud 640 into any number of pieces. In the embodiment shown in FIG. 6, the at least one slit 644 may be one slit extending from a point along the circumference of the connection stud 640 to an opposing point along the circumference of the connection stud 640. However, in other embodiments, not shown, the at least one slit may extend across less than all the connection stud. Thus, the opposing point may not be located along the circumference of the connection stud. In yet a further embodiment, wherein the connection stud is a polygonal connection stud, the at least one slit may separate any side of the polygon from another side of the polygon. In some embodiments, the at least one slit may separate each side of the polygon from another, however, in other embodiments, at least some of the sides may be connected. Further, in other embodiments, the at least one slit may dissect the polygonal connection stud at each side.

Returning to the embodiment shown in FIG. 6, the at least one slit 644 may extend from a distal end of the connection stud 640 to the inner surface 634 of the base 620. In other embodiments, however, the at least one slit may extend through less than all the height of the at least one connection stud. For example, and without limitation, the at least one slit may extend through twenty-five, fifty, or seventy-five percent of the at least one connection stud.

As shown in FIG. 6, the at least one slit 644 may divide the connection stud 640 into a plurality of pieces. In the embodiment shown, the connection stud 640 may be divided into two pieces. However, any number of pieces is contemplated and may be determined by the at least one slit.

In some embodiments, the pieces may be partially connected. Thus, the at least one slit may be operative to at least partially divide the connection studs into any number of pieces. However, in the embodiment shown in FIG. 6, each of the plurality of pieces may be a distinct piece. It is contemplated that in any of the aforementioned embodiments, the connection stud may be operative to flex on a distal end, so that the connection stud may removably secure with apertures of a variety of sizes.

Returning to the embodiments of the L-shaped stabilizing connector 100 and 600 illustrated in FIGS. 1, 3 and 6, the connection studs 140, 142, 640, and 642 may be located offset from a midline the base parallel to the second arm 124 and 624. However, in another embodiment, the connection studs 140, 142, 640, and 642 may be located along a midline of the base 120 and 620 parallel to the second arm 124 and 624.

Turning to the embodiment of the miter stabilizing connectors 200 and 501 shown in FIGS. 2, 4, and 5, the miter stabilizing connectors 200 and 501 may comprise a first connection stud 240, a second connection stud 242, and a third connection stud 244. For the purposes of brevity and clarity, the miter stabilizing connector 200 shown in FIGS. 2 and 4 is referenced and the miter stabilizing connector 501 in FIG. 5 is incorporated. The connection studs 240, 242, and 242 may extend off the inner surface 234 of the base 220.

The first connection stud 240 may be located on the first arm 222 and the third connection stud 244 may be located on the second arm 224. The second connection stud 242 may be located at the connection between the first arm 222 and the second arm 224. It is contemplated that a midline of the first connection stud 240 and a midline of the third connection stud 244 may intersect at the second connection stud 242.

It is contemplated that the miter stabilizing connector 200 may be operative to connect three of the plurality of tiles 310. More particularly, the miter stabilizing connector 200 may connect three of the plurality of tiles 310 arranged to form a right angle. In the embodiment shown in FIG. 4, the apertures 320 on the tiles are located near the corner of the tiles 310. It is contemplated that the tiles 310 may be arranged so that the at least one aperture 320 may receive the connection studs 240, 242, and 244. In some embodiments, not shown, the tiles 310 may comprise the at least one aperture 320 at any point along the tile 310. This may allow tiles 310 to be connected at a plurality of points.

It is contemplated that the miter stabilizing connector 200 may be operative to engage with less than three tiles. For example, the miter stabilizing connector 200 may engage with two tiles located in line with one another. In another example, the miter stabilizing connector 200 may engage with two tiles when the apertures are located at a diagonal to the other.

CONCLUSIONS, RAMIFICATIONS, AND SCOPE

While certain embodiments of the invention have been illustrated and described, various modifications are contemplated and can be made without departing from the spirit and scope of the invention. For example, the stabilizing connectors may be utilized to combine structural components such as a table, sidewalk, or other structural components. The tiles and stabilizing connectors may also be fabricated from many materials without departing from the invention. For instance, the tiles and stabilizing connector may comprise any variety of rugged and lightweight plastics as may be used and accepted in childrens' toys. Such acceptable materials may comprise, for instance, engineered plastics known in the art as ABS and MABS. Certain portions of the device and kit, such as the post comprising the stabilizing connector, may be at least partially magnetic to receive magnets, if necessary or desired. Accordingly, it is intended that the invention not be limited, except as by the appended claim(s).

The teachings disclosed herein may be applied to other devices and kits, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the stabilizing connector and building toy kit with which that terminology is associated. In general, the terms used in the following claims should not be constructed to limit the stabilizing connector and building toy kit to the specific embodiments disclosed in the specification unless the above description section explicitly define such terms. Accordingly, the actual scope encompasses not only the disclosed embodiments, but also all equivalent ways of practicing or implementing the disclosed device and kit. The above description of embodiments of the stabilizing connector and building toy kit is not intended to be exhaustive or limited to the precise form disclosed above or to a particular field of usage.

While specific embodiments of, and examples for, the device and kit are described above for illustrative purposes, various equivalent modifications are possible for which those skilled in the relevant art will recognize.

While certain aspects of the device and kit disclosed are presented below in particular claim forms, various aspects of the device and kit are contemplated in any number of claim forms. Thus, the inventor reserves the right to add additional claims after filing the application to pursue such additional claim forms for other aspects of the stabilizing connector and building toy kit.

What is claimed is:

1. A construction toy kit comprising:

at least one stabilizing connector comprising:

a base having a first arm, a second arm, an inner surface, and an outer surface; and a plurality of connection studs extending from the inner surface of the base; and at least one magnetized tile, each magnetized tile having a first face having a first perimeter and a second face having a second perimeter, the first face and the second face opposing one another and a sidewall joining each of the first perimeter to the second perimeter, each first and second face comprising an outer surface and an inner surface, at least one of the first and second face comprising at least one aperture configured to securely and removably receive one of the plurality of connection studs, wherein magnets are secured along the inner surface and the side wall of the at least one magnetized tile.

2. The construction toy kit of claim 1, wherein the at least one stabilizing connector further comprises a post extending from the outer surface of the base.

3. The construction toy kit of claim 2, wherein the post is configured to support at least one accessory.

4. The construction toy kit of claim 1, wherein the plurality of connection studs are selected from a group consisting of cylindrical connection studs, polygonal connection studs, and split-body connection studs.

5. The construction toy kit of claim 1, wherein the at least one aperture extends from the outer surface of the first face of the at least one magnetized tile through the outer surface of the second face of the at least one tile.

6. The construction toy kit of claim 1, wherein the second arm of the at least one stabilizing connector extends downwards from an edge of the first arm and the second arm is positioned parallel to the plurality of coupling studs.

7. The construction toy kit of claim 6, wherein the plurality of connection studs is two connection studs distributed across the inner surface of the first arm, each connection stud configured to removably secure with the aperture on the at least one magnetized tile and another aperture on at least one other tile.

8. The construction toy kit of claim 1, wherein the stabilizing connector is a miter stabilizing connector and the first arm and the second arm are connected to form a 90° angle.

9. The construction toy kit of claim 8, wherein the plurality of connection studs is three connection studs distributed across the inner surface of the first and second arms configured to removably secure the magnetized tile to a plurality of adjacent magnetized tiles.

10. The stabilizing connector of claim 3, wherein the accessory comprises at least one attachment means.

11. The construction toy kit of claim 9, wherein the plurality of connection studs comprises an "L" formation.

12. The construction toy kit of claim 11, wherein the plurality of connection studs comprises a "T" formation.

13. A method of building a toy construction from the construction toy kit of claim 1, comprising the steps of:

aligning a first connection stud of the plurality of connection studs of the stabilizing connector with a first aperture in a first magnetized tile; and removably securing the first connection studs in the first aperture.

14. The method of claim 13, further comprising the step of:

aligning a second connection stud of the plurality of connection studs of the stabilizing connector with a second aperture in either a first magnetized tile or a second magnetized tile; and removably securing the second connection stud to the second aperture.

15. The method of claim 14, wherein the second aperture is in the first magnetized tile.

16. The method of claim 15, wherein the second aperture is in the second magnetized tile.

17. The method of claim 16, further comprising the step of magnetically attracting the first magnetized tile to the second magnetized tile before removably securing the first connection stud to the first aperture.

18. The method of claim 17, further comprising the step of magnetically attracting the first magnetized tile to the second magnetized tile before removably securing the second connection stud to the second aperture.

19. The method of claim 18, further comprising the steps of:

aligning a third connection stud of the plurality of connection studs of the stabilizing connector with a third aperture in either the first magnetized tile, the second magnetized tile, or a third magnetized tile; and removably securing the third connection stud to the third aperture.

20. The method of claim 19, wherein the third aperture is in the third magnetized tile.

* * * * *